United States Patent [19]

Owens, Jr.

[11] 4,119,105

[45] Oct. 10, 1978

[54] AIR FLOW LIMITING FILTER

[75] Inventor: William F. Owens, Jr., Pisgah Forest, N.C.

[73] Assignee: Olin Corporation, Pisgah Forest, N.C.

[21] Appl. No.: 764,007

[22] Filed: Jan. 31, 1977

[51] Int. Cl.[2] ..... A24D 1/04

[52] U.S. Cl. ..... 131/10.3; 131/187; 131/198 R

[58] Field of Search ..... 131/215 B, 198 A, 198 R, 131/84, 10.3, 10.5, 206, 210, 216, 227, 261 R, 261 B, 215, 170 R, 170 A, 171 R, 187, 11; 93/1 C

[56] References Cited

U.S. PATENT DOCUMENTS

| | | | |
|---|---|---|---|
| 1,925,936 | 9/1933 | Sanson | 131/215 B |
| 2,709,441 | 5/1955 | Motsinger | 131/227 |
| 3,630,210 | 12/1971 | Haslam | 131/215 B |
| 3,685,522 | 8/1972 | Kleinhans | 131/198 A |
| 3,394,707 | 7/1968 | Ellis | 131/10.5 |

*Primary Examiner*—Robert W. Michell
*Assistant Examiner*—V. Millin
*Attorney, Agent, or Firm*—Robert W. Habel

[57] ABSTRACT

An improved smoke control device for smoking articles which contains a valve operative to close off the flow of smoke drawn through the smoking article depending upon the pressure drop or draw rate of each individual puff. Preferably, the valve comprises a resilient flap member responsive to the puff pressure drop for restricting or closing off smoke drawn through the smoking article and which will reopen after the pressure is relieved, thereby limiting each puff to a predetermined yield consistent with that obtainable in a normal puff.

5 Claims, 8 Drawing Figures

AIR FLOW LIMITING FILTER

BACKGROUND OF THE INVENTION

1. Field of the Invention

This invention relates generally to filters for smoking articles and more particularly to filtering devices for controlling the amount of smoke drawn through a smoking article such as cigarettes, cigars and the like.

2. Description of the Prior Art

Various types of filters have been designed for removing or reducing undesirable constituents in the smoke from smoking articles. Most commonly, such filters take the form of a mass of fibers, paper or other porous and semiporous materials through which the smoke must pass, thereby entraining some of the constituents present in the smoke.

Other types of smoke filterng devices have been proposed which utilize valves or various designs which tend to open upon a predetermined amount of suction being applied by the smoker when drawing on the smoking article. Typical devices of this nature are disclosed in U.S. Pat. Nos. 2,709,441; 3,533,414; 3,616,802; and 3,685,522. However, filter valves of this type have the disadvantage of increasing the amount of smoke drawn through the smoking article as the pressure or suction is increased by the draw in any individual puff, thereby opening the valve and thus increasing the amount of smoke and attendant constituents passing through the valve to the smoker.

Cigarette filter devices have also been proposed that contain valves which are designed to close by the hot smoke from the approaching coal as the cigarette is smoked and thereby reduce the amount of smoke that can be drawn through the cigarette, particularly in the last half of the cigarette. Examples of this type of filter valve are disclosed in U.S. Pat. No. 3,800,805. However, such valves have the disadvantage that they are responsive to the heat from the smoke and only operate to close when the heat gets high enough or the burning coal close enough to activate the valve. At all other times the valve remains open without any restriction placed upon the amount of smoke that can be drawn through the cigarette.

All of the foregoing disadvantages become important when considered in light of the new lower tar and nicotine cigarettes currently being produced. Many smokers in order to achieve the same level of nicotine they have been accustomed to tend to draw harder with a greater volume of smoke in each puff, thereby obtaining a greater yield of nicotine and tar in each puff and defeating the purpose for which the such cigarettes were designed.

Accordingly, it is an object of this invention to provide a smoke control device for smoking articles and the like not having the disadvantages of the above prior art filter devices. Another object of this invention is to provide a smoke control device which will limit the volume of smoke that can be drawn in any puff depending upon the pressure drop or rate of draw induced by the smoker.

SUMMARY OF THE INVENTION

In accordance with this invention, a smoke control device is provided containing a valve means responsive to pressure drop in any puff such that as the puff draw rate exceeds a predetermined level the valve closes, thereby limiting and controlling the amount of smoke that can be inhaled in each puff. The structure is designed so that only a normal puff can be taken on the smoking article for the valve to remain open and when a greater rate is attempted by the smoker the valve automatically closes. After each puff, the valve returns to its open position and remains open unless an excessive pressure drop occurs in the next puff whereby it closes again. From the foregoing it can be seen that the delivery of tar and nicotine in each puff is limited to the delivery that would normally be obtained from the smoking article such as a low tar/nicotine cigarette and cannot be increased by the smoker by increasing the draw rate in any single puff.

BRIEF DESCRIPTION OF THE DRAWINGS

In order that the invention may be more readily understood and carried into effect, reference is made to the accompanying drawings and detailed description thereof, which are offered by way of illustration only and not in limitation of the invention, the scope which is defined by the appended claims rather than any description preceding them.

In the drawings.

DETAILED DESCRIPTION OF THE PREFERRED EMBODIMENTS

Figure 1:
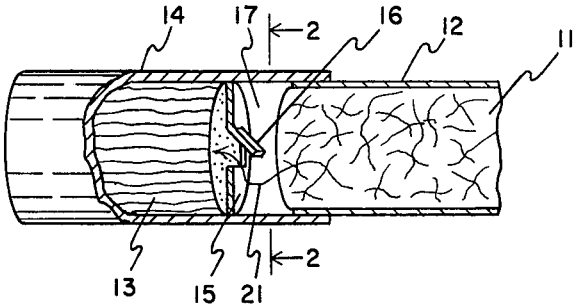
FIG. 1 is a perspective view partially in section showing one type of flap valve in the open position in a cigarette mouthpiece.
Figure 2:
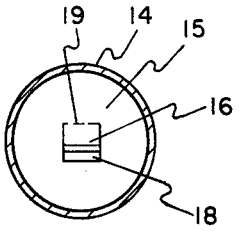
FIG. 2 is a cross section of the mouthpiece showing the valve of FIG. 1 taken along lines 2—2 of FIG. 1.
Figure 3:
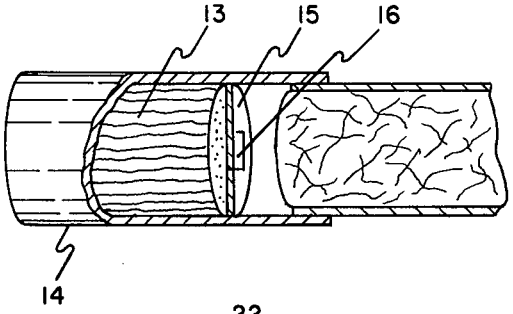
FIG. 3 is a view of the same mouthpiece as FIG. 1 with the valve in the closed position.

Referring now to the embodiment illustrated in FIGS. 1, 2, and 3, the mouthpiece portion of a cigarette is shown comprising a tobacco column 11, wrapped in cigarette paper 12 to which is affixed a filter plug 13 by tipping paper 14. Within the tube formed by tipping paper 14, there is positioned a circular member 15 abutting filter plug 13 and of equal diameter thereto containing a movable flap valve 16 which in the open position of FIG. 1 bends into chamber 17 within the tube. When flap 16 is bent, an opening 18 is provided in member 15. The contiguous surfaces of member 15 and filter plug 13 may be affixed together by an adhesive or glue to assure that the member is held in the proper position within the tipping paper tube.

Member 16 is made of material that is substantially air impermeable and, therefore, impervious to the gaseous and particulate vapors drawn through the cigarette such as tars, nicotine, and vapor phase constituents normally present in tobacco smoke. Typically suitable materials are paper, preferably heavier gauge cigarette tipping paper, and flexible plastic films such as cellophane, polyethylene, polypropylene, and the like. Flap 16 is cut out of the center of member 15 along three sides and bent or folded on the fourth side along line 19 such that it is normally in the open position. The materials employed for member 15 should be sufficiently resilient so that flap valve 16 will return to the open position shown in FIG. 1 from the closed position shown in FIG. 3 when pressure on the valve is removed.

Operation of the valve is uncomplicated and provides a positive means of controlling volume and rate of draw on the cigarette in any single puff, thus limiting the amount of nicotine available to the smoker. As shown in FIG. 1, arrow 21 indicates the normal path traveled by the smoke through the cigarette starting with tobacco column 11, through chamber 19, opening 18 provided by flap valve 16, and thence through the porous filter medium of filter plug 13 before entering the smoker's mouth. As long as the pressure drop or volume and rate of draw in any puff is normal, flap valve 16 remains open. However, if the pressure becomes excessive, flap valve 16 closes as shown in FIG. 3, preventing further smoke from reaching the smoker's mouth in that puff. When the pressure is released at the end of the puff, the flap automatically returns to the open position shown in FIG. 1, again allowing smoke to be drawn through the cigarette on the next puff.

Figure 4:
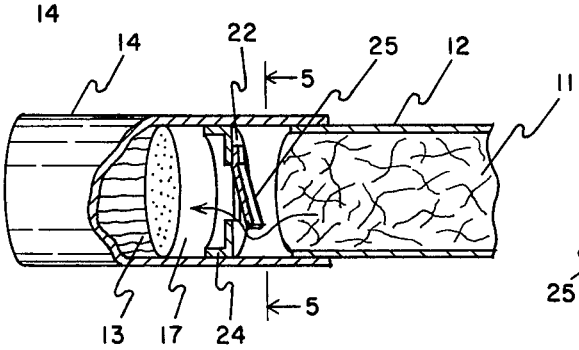
FIG. 4 is a perspective view partially in section showing another embodiment of a flap valve in the open position in a cigarette mouthpiece.
Figure 5:
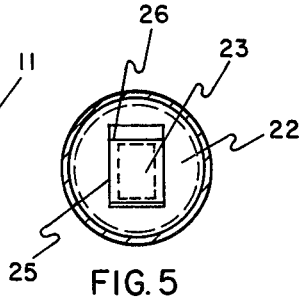
FIG. 5 is a section of the mouthpiece showing the valve of FIG. 4 taken along lines 5—5 of FIG. 4.
Figure 6:
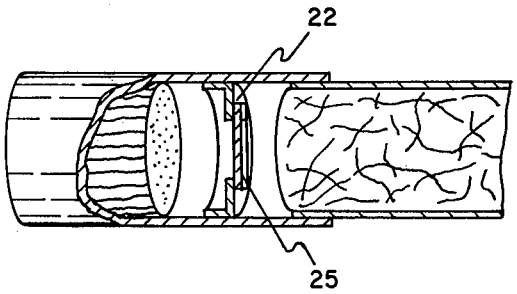
FIG. 6 is a view of the same mouthpiece as FIG. 4 with the valve in the closed position.

In FIGS. 4, 5, and 6, another embodiment of the invention is shown in which like parts of the cigarette and mouthpiece of FIG. 1 are referred to with like numerals. Thus, within the chamber 17 between filter plug 13 and tobacco column 11 is positioned a circular member 22 having a rectangular opening 23 cut in its center section as shown by the dotted lines in FIG. 5. Shoulder 24 at the outer periphery of member 22 is provided to adhesively seal the member to the inner wall of tipping paper 14 and hold it in position within chamber 17. A flap valve 25 slightly larger than opening 23 is positioned over the opening and glued to member 22 along one side. A bend or crease along line 26 allows the valve to be normally open. The same materials described above to make circular member 15 in FIG. 1 may be used to make member 22 and flap valve 25. Alternately, the entire assembly comprising member 22 and valve 25 may be molded from a plastic polymer material with shoulder 24 extending in both directions to form a tubular piece coextensive in length with the distance between the end of the tobacco column and the filter plug or if a filter plug is not employed of sufficient length to reach the end of the cigarette mouthpiece. As shown more clearly in FIG. 6, when excessive pressure is applied by the smoker in any puff, flap valve 25 closes preventing further smoke from passing through the cigarette, thus limiting the nicotine yield in that puff.

Figure 7:
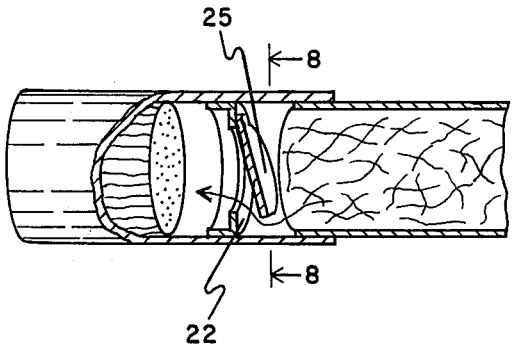
FIG. 7 shows another embodiment of a flap valve similar to the preceding views with the valve in the open position.
Figure 8:
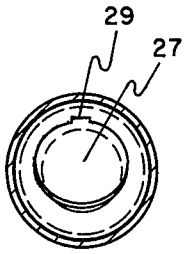
FIG. 8 is a section of the mouthpiece of FIG. 7 taken along lines 8—8 of FIG. 7.

A similar embodiment is shown in FIGS. 7 and 8 in which a circular opening 27 is provided in member 25 overlaid by a slightly larger circular flap valve 28 glued at tab 29 to member 25. In this embodiment, the device is made of the same materials and functions in the same manner as the embodiments heretofore described.

The pressure drop in a normal puff on a cigarette will vary depending on the smoker between 3 to 10 inches of water at 17.5 cc per second air flow. Accordingly, and in order to prevent an excessive draw in any one puff on a cigarette or other smoking article, the flap valves of this invention are preferably designed to close whenever the pressure drop exceeds 10 inches of water at 17.5 cc per second air flow. Of course, it is apparent that they can be designed to close at lower or higher pressure drops depending upon the specific requirements of the smoking article. Also, while all of the drawings illustrate the flap valve in combination with a filter plug, it is to be understood that valves according to the invention can be employed with or without a filter and with a variety of smoking articles such as cigarettes, cigars, pipes, etc., where a smoke control limiting means would be desirable.

It will thus be seen from the foregoing description that an improved smoke control device is provided to limit the delivery of nicotine and tar in any single puff on the smoking article to that obtainable in a normal puff. Although the invention has been described in conjunction with the preferred embodiments and drawings, they are only illustrative of the invention and it is to be understood that many variations and modifications may be resorted to without departing from the spirit and scope of the invention, as those skilled in the art will readily understand.

What is claimed is:

1. A filtering device for controlling the amount of smoke that can be drawn from a smoking article during each puff comprising a cylindrical tipping envelope forming a mouthpiece for mounting on one end of the smoking article, a valve mounted inside said tipping envelope biased in an opened position and providing when open the sole passage for smoke drawn through the tipping envelope from the smoking article, said valve comprising an air-impermeable baffle, an aperture in said baffle and a pressure responsive resilient flap at least as large as said aperture on the side of said baffle nearest to said one end of the smoking article which temporarily closes said aperture by bending towards the aperture whenever the pressure drop during any puff exceeds a predetermined level, and then opens by bending away from the aperture towards the end of the smoking article on which the tipping envelope is mounted after the puff is completed.

2. The filtering device of claim 1 in which a filter plug is mounted within said tipping envelope abutting said baffle on the side opposite from said resilient flap, said filter plug and baffle adhered together along the area of their contiguous surfaces.

3. The filtering device of claim 1 in which a tubular shoulder extends from the periphery of said baffle and the baffle is adhered to the tipping envelope along the area of their contiguous surfaces.

4. The filtering device of claim 1 in which said resilient flap is an integral part of said baffle.

5. The smoke control device of claim 1 in which said resilient flap is mounted on said baffle and is slightly larger than said aperture.

* * * * *